US009563177B1

(12) United States Patent
Rothkopf

(10) Patent No.: US 9,563,177 B1
(45) Date of Patent: Feb. 7, 2017

(54) CONTEXT-AWARE WORLD CLOCK

(71) Applicant: Apple Inc., Cupertino, CA (US)

(72) Inventor: Fletcher R. Rothkopf, Los Altos, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/569,478

(22) Filed: Dec. 12, 2014

Related U.S. Application Data

(60) Provisional application No. 61/917,609, filed on Dec. 18, 2013.

(51) Int. Cl.
*G04G 9/00* (2006.01)
*G04B 19/22* (2006.01)

(52) U.S. Cl.
CPC ..... *G04G 9/0076* (2013.01); *G04B 19/22* (2013.01)

(58) Field of Classification Search
CPC .... G04G 9/0076; G04G 9/00; H04M 2250/60; H04M 1/72566; H04M 3/38; G04B 19/22
See application file for complete search history.

(56) References Cited

U.S. PATENT DOCUMENTS 5,845,257 A * 12/1998 Fu ..... G06F 15/0266 368/21
8,824,341 B2 * 9/2014 Logan ..... G06Q 10/109 370/260
9,125,009 B2 * 9/2015 Felt ..... H04W 4/02
9,282,181 B2 * 3/2016 Antos ..... H04M 1/72583
2008/0153474 A1 * 6/2008 Scott ..... H04L 51/38 455/418
2010/0062714 A1 * 3/2010 Ozaki ..... H04M 1/274516 455/41.3
2011/0055196 A1 3/2011 Sundelin
2011/0231407 A1 9/2011 Gupta
2012/0246245 A1 9/2012 Nilsson
2013/0034221 A1 * 2/2013 Aaron ..... H04M 1/72519 379/157
2013/0109361 A1 * 5/2013 Felt ..... H04W 4/02 455/414.1
2013/0254233 A1 9/2013 Fagundes
2015/0177702 A1 * 6/2015 Kehoe ..... H04M 1/72519 368/21
2015/0271318 A1 * 9/2015 Antos ..... H04M 1/72583 455/412.1

* cited by examiner

*Primary Examiner* — Sean Kayes

(57) ABSTRACT

Time information for various locations can be automatically generated for display on a portable electronic device. The time information can include time information for remote locations away from the current location of a user. The time information can be generated without requiring user input specifying the locations. The locations can be determined or identified based on context information of the user or context information of contacts of the user. The locations can be prioritized and the time information can be displayed according to the prioritization.

28 Claims, 7 Drawing Sheets

400

| 402 CONTACT | 404 DEFAULT LOCATION | 406 CONFIDENCE | 408 CURRENT LOCATION | 410 CONFIDENCE | 412 FUTURE LOCATION | 414 CONFIDENCE |
|---|---|---|---|---|---|---|
| Agnes | San Francisco | 91% | London | 100% | San Francisco | 100% |
| Aunt Grace | London | 100% | London | 50% | - | - |
| Ava | New York | 66% | New York | 50% | - | - |
| Dad | San Francisco | 100% | San Francisco | 90% | Paris | 80% |

400

| 402 CONTACT | 404 DEFAULT LOCATION | 406 CONFIDENCE | 408 CURRENT LOCATION | 410 CONFIDENCE | 412 FUTURE LOCATION | 414 CONFIDENCE |
|---|---|---|---|---|---|---|
| Agnes | San Francisco | 91% | London | 100% | San Francisco | 100% |
| Aunt Grace | London | 100% | London | 50% | - | - |
| Ava | New York | 66% | New York | 50% | - | - |
| Dad | San Francisco | 100% | San Francisco | 90% | Paris | 80% |

FIG. 4

500

| 502 LOCATION | 504 TIME ZONE | 506 CONTACTS | 508 RANK SCORE |
|---|---|---|---|
| San Francisco, CA | PDT | Dad, Mary, Mom | 372 |
| New York, NY | EDT | Ava, Frank, Sophia | 360 |
| Las Vegas, NV | PDT | Emily, Liz, Rick, Sam | 355 |
| London, UK | BST | Agnes, Aunt Grace, Jerry | 326 |

FIG. 5

600

| 602 TIME ZONE | 604 LOCATIONS | 606 CONTACTS | 608 RANK SCORE |
|---|---|---|---|
| PDT | Las Vegas, San Francisco | Mom, Dad, Emily, Liz, Mary, Rick, Sam | 727 |
| EDT | New York | Ava, Frank, Sophia | 360 |
| BST | London | Agnes, Aunt Grace, Jerry | 326 |

FIG. 6

CONTEXT-AWARE WORLD CLOCK

CROSS-REFERENCE TO RELATED APPLICATION

This application claims the benefit of U.S. Provisional Application No. 61/917,609, filed Dec. 18, 2013, titled "Context-Aware World Clock," the disclosure of which is incorporated by reference herein in its entirety.

BACKGROUND

The present disclosure relates generally to portable electronic devices, and in particular to portable electronic devices that provide time information.

Portable electronic devices may have the capability to present time information such as a digital or analog clock on a user interface of the portable electronic device. Portable electronic devices may also have the capability to track the location of a user, for example, by using Global Positioning System (GPS) receivers. As the user travels to a different city or to a different location, the digital or analog clock presented on the user interface of the portable electronic device can be updated to correspond to the current location of the user. However, in some instances, the user may be interested in knowing the local time of a city or location away from the current location of the user.

Although some portable electronic devices may provide the capability for a user to manually type in remote locations such as city names to retrieve time information for remote locations, the manual entry process can be cumbersome and may be susceptible to typographical errors. Furthermore, the form factor of some portable electronic devices may not be suitable for such manual entry. For example, a small electronic device may not have sufficient surface area on a user interface to accommodate the display of a virtual keyboard to enable a user to manually type in city names.

SUMMARY

Various embodiments of the present invention relate to systems, devices, and methods for automatic generation of time information for display on a portable electronic device. The time information can include time information such as local time or time information for remote locations away from the current location of a user of the portable electronic device. Techniques described herein can provide automatic generation of time information for remote locations that may be of interest to the user without requiring user input specifying the remote locations. The remote locations can be determined, for example, from context information of the user and/or context information relating to the contacts of the user.

The following detailed description together with the accompanying drawings will provide a better understanding of the nature and advantages of the present invention.

BRIEF DESCRIPTION OF THE DRAWINGS

FIG. 4 illustrates examples of location records according to some embodiments.

FIG. 5 illustrates an example of a prioritized list of locations with time information according to some embodiments.

FIG. 6 illustrates an example of a prioritized list of time zones according to some embodiments.

DETAILED DESCRIPTION

Certain embodiments of the present invention provide systems, devices, and methods for automatic generation of time information for display on a portable electronic device. The time information can include time information for remote locations away from the current location of the portable electronic device, such as cities and/or times zones of interest that are outside of the current geographical area of the user. The locations can be identified or be determined based on context information relating to the user of the portable electronic device, and/or context information relating to contacts of the user. The locations can be automatically identified or determined by the portable electronic device, or by another device that can communicate with the portable electronic device. The locations may include, for example, locations of one or more contacts of the user of the portable electronic device, locations that a user may be travelling to in the future or has travelled to in the past, locations pictured in images viewed by a user, and/or other locations where the local time may be of interest to a user of the portable electronic device, etc.

In some embodiments, the locations can be prioritized such that time information for a selected number of the identified or determined locations are available for display on the portable electronic device. The prioritization can be performed based on one or more factors indicating how useful the time information may be to a user, and/or how significant the location may be to the user. The time information can be displayed for a user according to the prioritization. For example, the time information for the locations can be displayed on a user interface as a list of world clocks indicating the local time at each location, and the world clocks may be arranged according to the order of prioritization. In some embodiments, the time information can be displayed on a user interface as part of a contacts list or as part of contact records of contacts of the user. The time information can also be displayed as part of a notification and/or a prompt when the user attempts to initiate a communication with a contact, or when a user invokes a functionality of the portable electronic device for which the display of such time information may be useful.

Figure 1:
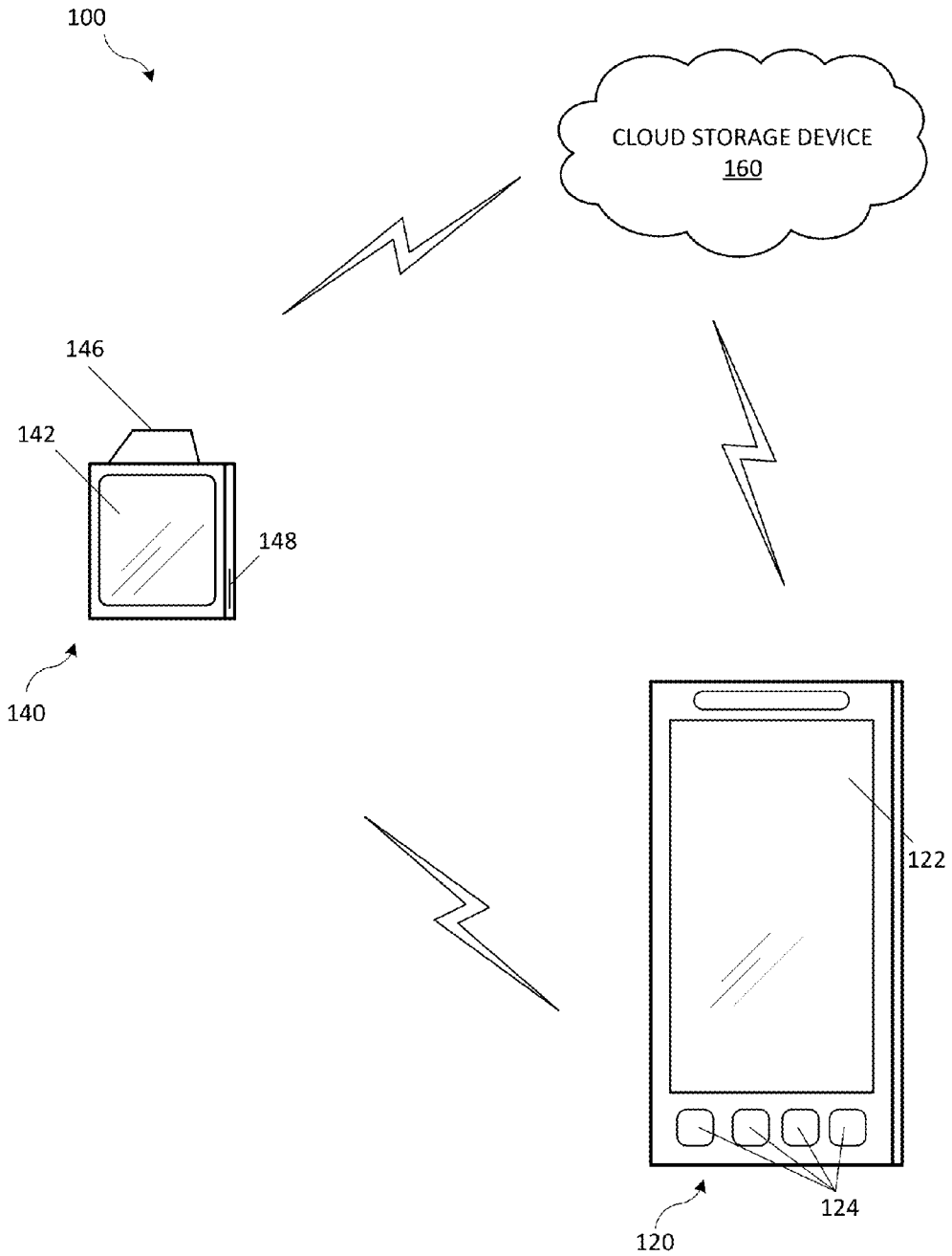
FIG. 1 illustrates a system of electronic devices according to some embodiments.

FIG. 1 illustrates a system 100 of electronic devices that can individually or cooperatively be used to automatically generate time information for display on a portable electronic device, according to some embodiments. System 100 includes portable electronic devices 120 and 140, and a cloud storage device 160. The devices in system 100 can be communicatively coupled to each other, and may wirelessly communicate with each other using any one or more suitable wireless protocols such as WiFi (IEEE 802.11 family of standards), Bluetooth, near field communication (NFC), cellular data communication protocols (e.g., LTE, GSM, CDMA, HSPA, GSM, etc.), or other protocols for wireless data communication. In some embodiments, some devices in system 100 may also communicate using a wired connection, for example, by using a connection cable. It should be understood that other embodiments may have fewer devices or may include additional devices that are not shown. For example, some embodiments can include a desktop or laptop computer that can be communicatively coupled with any of the devices in system 100 (e.g., portable electronic device 120 and/or portable electronic device 140). In other embodiments, system 100 can include a single standalone device such as portable electronic device 120 or portable electronic device 140.

Portable electronic device 120 can be a handheld electronic device such as a mobile phone (e.g., a smartphone) as shown, or other types of handheld electronic device (e.g., a tablet, a portable media player/reader, a personal digital assistant, a portable gaming device, etc.) that can be held by a user. Portable electronic device 120 can include a user interface such as a display 122 to present information for a user. In some embodiments, display 122 can be part of a touchscreen interface that can accept user input. Portable electronic device 120 can also include one or more buttons 124 that a user can engage with to operate and control portable electronic device 120.

In some embodiments, portable electronic device 120 can generate time information for locations of interest without interacting with other devices of system 100, and the time information can be displayed on the user interface of portable electronic device 120 (e.g., display 122) for a user. In some embodiments, portable electronic device 120 can alternatively or additionally act as a host device to provide information or data for a peripheral portable electronic device (e.g., portable electronic device 140) to enable the peripheral portable electronic device to generate and/or display the time information. In some embodiments, portable electronic device 120 can alternatively or additionally interact with one or more other electronic devices (e.g., a host device such as a laptop, a netbook, an ultrabook, desktop or personal computer, and/or cloud storage device 160, etc.) to access information or data to generate or receive time information for display on the user interface of portable electronic device 120 (e.g., display 122), or for display on a user interface of a peripheral portable electronic device (e.g., portable electronic device 140).

Portable electronic device 140 can be a wearable electronic device that worn by a user, such as a watch, a bracelet, glasses, a necklace, a ring, a belt, a jacket, a clip-on or pin-on device that has a clip or pin portion that attaches to the user's clothing, etc. Portable electronic device 140 can include a wearable element 146 such as a clip or strap that allows portable electronic device 140 to be removably worn by a user (e.g., attached to a user's wrist, belt, or clothing). Portable electronic device 140 can also include a user interface such as a display 142 to present information for a user. In some embodiments, display 142 can be part of a touchscreen interface that can accept user input. Portable electronic device 140 can also include one or more buttons (not shown) that a user can engage with to operate and control portable electronic device 140. In some embodiments, portable electronic device 140 may also include a connection port 148 or the like that can be used to provide a wired connection (e.g., via a connection cable) to a host device (e.g., portable electronic device 120).

In some embodiments, portable electronic device 140 can generate time information for locations of interest without interacting with the other devices of system 100, and the time information can be displayed on user interface 142 of portable electronic device 140 for a user. In some embodiments, portable electronic device 140 can alternatively or additionally interact with one or more other devices (e.g., a host device such as portable electronic device 120, a laptop, a netbook, an ultrabook, desktop or personal computer, and/or cloud storage device 160, etc.) to access information or data to generate or receive time information for display on user interface 142 of portable electronic device 140.

In some embodiments, portable electronic device 140 and portable electronic device 120 can interoperate to enhance the functionality available on either device. For example, portable electronic device 140 and portable electronic device 120 can establish a pairing using a wireless communication technology such as Bluetooth, etc. While the devices are paired, portable electronic device 120 acting as a host device can send notifications of selected events (e.g., receiving a phone call, text message, or email message) or information to portable electronic device 140, and portable electronic device 140 can present the corresponding alerts or information to the user. A user may also engage user interface 142 of portable electronic device 140 to initiate an action on portable electronic device 120, such as placing a phone call, sending a text message, or controlling media playback operations of portable electronic device 120.

Cloud storage device 160 can be implemented as one or more remote storage devices that are accessible by portable electronic device 120 and/or portable electronic device 140, e.g., via a network such as the Internet. Cloud storage device 160 can host information or data used by portable electronic device 120 and/or by portable electronic device 140 to generate time information for display on a user interface of portable electronic device 120 and/or on a user interface of portable electronic device 140. In some embodiments, cloud storage device 160 may also include computing capabilities, and may include one or more computers or server computers coupled to the one or more remote storage devices. In such embodiments, cloud storage device 160 may be capable of generating the time information for portable electronic device 120 and/or portable electronic device 140, and the time information generated by cloud storage device 160 can be transmitted to portable electronic device 120 and/or portable electronic device 140.

Figure 2:
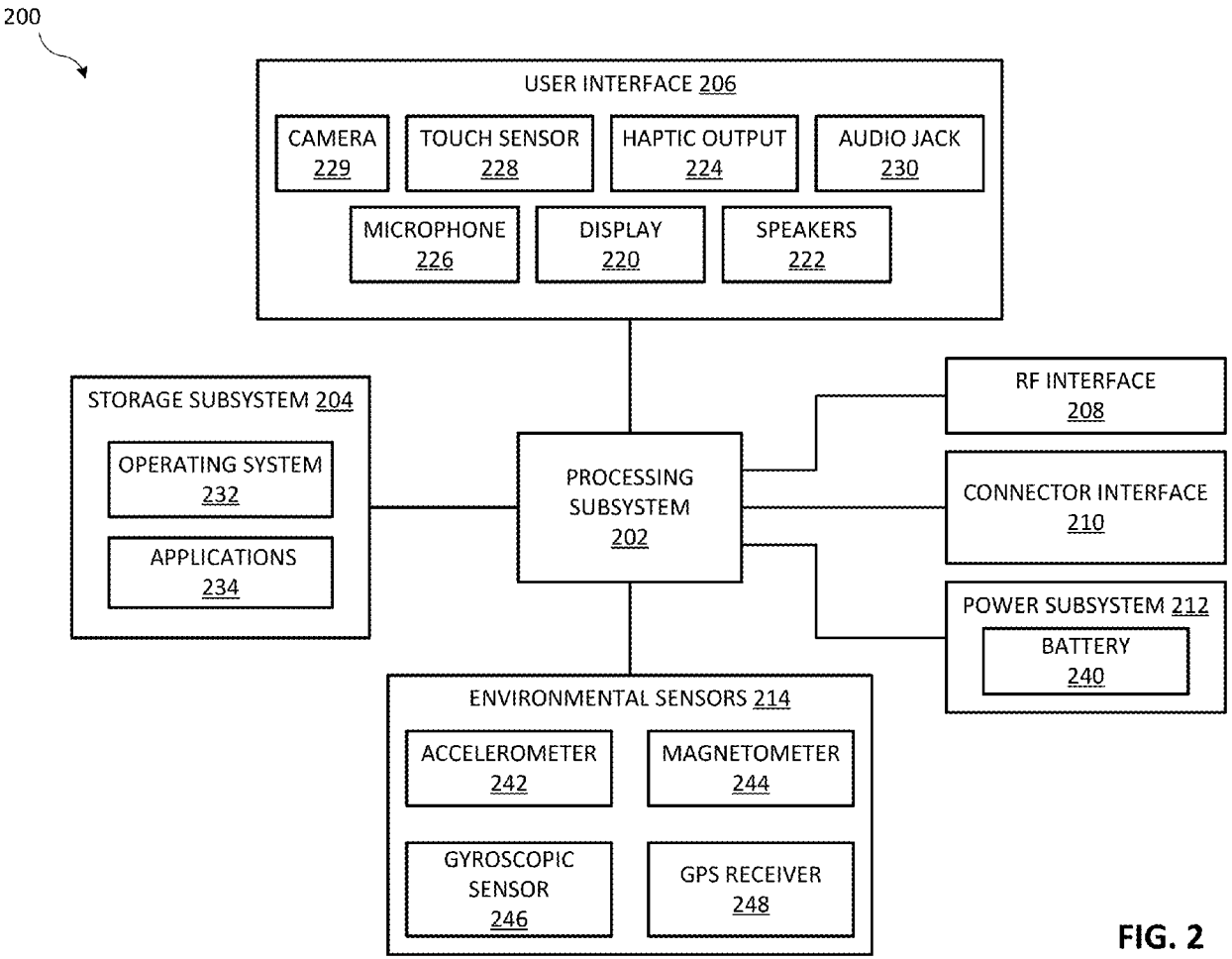
FIG. 2 illustrates a block diagram of a portable electronic device according to some embodiments.

FIG. 2 illustrates a block diagram of a portable electronic device 200 (e.g., implementing portable electronic device 120 and/or 140) according to some embodiments. Portable electronic device 200 can include processing subsystem 202, storage subsystem 204, user interface 206, RF interface 208, connector interface 210, power subsystem 212, and environmental sensors 214. Portable electronic device 200 can also include fewer components and/or other components not explicitly shown.

Storage subsystem 204 can be implemented, for example, using magnetic storage media, flash memory, other semiconductor memory (e.g., DRAM, SRAM), or any other non-transitory storage medium, or a combination of media, and can include volatile and/or non-volatile media. In some embodiments, storage subsystem 204 can store an operating system 232 and one or more applications 234 to be executed by processing subsystem 202, such as personal information management applications (e.g., contacts applications, calendar applications, etc.), communication applications (e.g., email applications, text messaging applications, voice call applications, instant messaging applications, etc.), productivity applications (e.g., document viewer or editor applications, etc.), travel applications (e.g., mapping and navigation applications, directory assistance applications, location sharing applications, travel planning and management applications, destination guide applications, etc.), web browser applications, social networking applications, photo or imaging applications (including video), media playback applications, video game applications, interface applications used for interacting with other devices (e.g., a host device), etc. Storage subsystem 204 can also store media items (e.g., audio files, video files, image or artwork files, etc.), information about a user's contacts (names, addresses, phone numbers, etc.), information about a user's calendar (e.g., scheduled appointments and events, etc.), notes, and/or other types of information.

User interface 206 can include any combination of input and output elements. A user can operate input elements of user interface 206 to invoke the functionality of portable electronic device 200 and/or of another device communicatively coupled to portable electronic device 200, and can view, hear, and/or otherwise experience output from portable electronic device 200 via output elements of user interface 206. Some user interface elements can provide both input and output functionalities.

Examples of output elements can include display 220, speakers 222, and haptic output generator 224. Display 220 can be implemented using compact display technologies such as LCD (liquid crystal display), LED (light emitting diode), OLED (organic light emitting diode), etc. In some embodiments, display 220 can incorporate a flexible display element or curved glass display element, allowing portable electronic device 200 to conform to a desired shape. One or more speakers 222 can be provided using small form factor speaker technologies, including any technology capable of converting electronic signals into audible sound waves. In some embodiments, speakers 222 can be used to produce tones (e.g., beeping or ringing) and can but need not be capable of reproducing sounds such as speech or music with any particular degree of fidelity. Haptic output generator 224 can be a device that converts electronic signals into vibrations that can be felt by a user of portable electronic device 200.

Examples of input elements can include microphone 226, touch sensor 228, and camera 229. Microphone 226 can include any device that converts sound waves into electronic signals. In some embodiments, microphone 226 can be sufficiently sensitive to provide a representation of specific words spoken by a user, or can be usable to provide indications of general ambient sound levels without necessarily providing a high quality electronic representation of specific sounds.

Touch sensor 228 can include, for example, a capacitive sensor array with the ability to localize contacts to a particular point or region on the surface of the sensor and in some instances, the ability to distinguish multiple simultaneous contacts. In some embodiments, touch sensor 228 can be overlaid over display 220 to provide a touchscreen interface, and processing subsystem 202 can translate touch events (including taps and/or other gestures made with one or more contacts) into specific user inputs depending on what is currently displayed on display 220.

Camera 229 can include, for example, a compact digital camera that includes an image sensor such as a CMOS sensor and optical components (e.g. lenses) arranged to focus an image onto the image sensor, along with control logic operable to use the imaging components to capture and store still and/or video images. Images can be stored, for example, in storage subsystem 204 and/or transmitted by portable electronic device 200 to other devices for storage. Depending on implementation, the optical components can provide fixed focal distance or variable focal distance; in the latter case, autofocus can be provided.

In some embodiments, user interface 206 can provide output to and/or receive input from an accessory device such as a headset. For example, audio jack 230 can connect via an audio cable (e.g., a standard 2.5 mm or 3.5 mm audio cable) to an auxiliary device. Audio jack 230 can include input and/or output paths. Accordingly, audio jack 230 can provide audio to the accessory device and/or receive audio from the accessory device. In some embodiments, a wireless connection interface can be used to communicate with an accessory device.

Processing subsystem 202 can be implemented as one or more integrated circuits, e.g., one or more single core or multicore microprocessors and/or microcontrollers. In operation, processing system 202 can control the operation of portable electronic device 200. In various embodiments, processing subsystem 202 can execute a variety of programs in response to program code and can maintain multiple concurrently executing programs or processes. At any given time, some or all of the program code to be executed can be resident in processing subsystem 210 and/or in storage media such as storage subsystem 204.

RF (radio frequency) interface 208 can allow portable electronic device 200 to communicate wirelessly with various other devices. RF interface 208 can include RF transceiver components such as an antenna and supporting circuitry to enable data communication over a wireless medium using any one or more suitable protocols for wireless data communication. RF interface 208 can be implemented using a combination of hardware (e.g., driver circuits, antennas, modulators/demodulators, encoders/decoders, and other analog and/or digital signal processing circuits) and software components. Multiple different wireless communication protocols and associated hardware can be incorporated into RF interface 208.

Connector interface 210 can allow portable electronic device 200 to communicate with various host devices via a wired communication path, e.g., using Universal Serial Bus (USB), universal asynchronous receiver/transmitter (UART), or other protocols for wired data communication. In some embodiments, connector interface 210 can provide a power port, allowing portable electronic device 200 to receive power, e.g., to charge an internal battery. For example, connector interface 210 can include a connector such as a mini USB connector or a custom connector, as well as supporting circuitry. In some embodiments, the connector can be a custom connector that provides dedicated power and ground pads, as well as digital data pads that can be used to implement different communication technologies in parallel; for instance, two pins can be assigned as USB data pins (D+ and D) and two other pins can be assigned as serial transmit/receive pins (e.g., implementing a UART interface). The assignment of pins to particular communication technologies can be hardwired or negotiated while the connection is being established. In some embodiments, the connector can also provide connections for audio and/or video signals, which may be transmitted to or from portable electronic device 202 in analog and/or digital formats.

Power subsystem 212 can provide power and power management capabilities for portable electronic device 200. For example, power subsystem 212 can include a battery 240 (e.g., a rechargeable battery) and associated circuitry to distribute power from battery 240 to other components of portable electronic device 200 that require electrical power. In some embodiments, power subsystem 212 can also include circuitry operable to charge battery 240, e.g., when connector interface 210 is connected to a power source. In some embodiments, power subsystem 212 can include a wireless charger, such as an inductive charger, to charge battery 240 without relying on connector interface 210. In some embodiments, power subsystem 212 can also include other power sources, such as a solar cell, in addition to or instead of battery 240.

Environmental sensors 214 can include various electronic, mechanical, electromechanical, optical, or other devices that provide information related to external conditions around portable electronic device 200. Environmental sensors 214 in some embodiments can provide digital signals to processing subsystem 202, e.g., on a streaming basis or in response to polling by processing subsystem 202 as desired. Any type and combination of environmental sensors can be used; shown by way of example are accelerometer 242, a magnetometer 244, a gyroscope 246, and a GPS receiver 248.

Some environmental sensors can provide information about the location and/or motion of portable electronic device 200. For example, accelerometer 242 can sense acceleration (relative to freefall) along one or more axes, e.g., using piezoelectric or other components in conjunction with associated electronics to produce a signal. Magnetometer 244 can sense an ambient magnetic field (e.g., Earth's magnetic field) and generate a corresponding electrical signal, which can be interpreted as a compass direction. Gyroscopic sensor 246 can sense rotational motion in one or more directions, e.g., using one or more MEMS (micro electro mechanical systems) gyroscopes and related control and sensing circuitry. Global Positioning System (GPS) receiver 248 can determine location based on signals received from GPS satellites.

It should be understood that the components of portable electronic device 200 shown in FIG. 2 are illustrative, and that variations and modifications are possible. For example, in some embodiments, a user interface can include any combination of any or all of the components described above, as well as other components not expressly shown or described. For example, in some embodiments, the user interface can include, e.g., just a touchscreen, or a touchscreen and a speaker, or a touchscreen and a haptic device. Where portable electronic device 200 has an RF interface, a connector interface can be omitted, and all communication between the portable electronic device and other devices can be conducted using wireless communication protocols. A wired power connection, e.g., for charging a battery of the portable electronic device, can be provided separately from any data connection.

Further, while the portable electronic device is described with reference to particular blocks, it is to be understood that these blocks are defined for convenience of description and are not intended to imply a particular physical arrangement of component parts. Further, the blocks need not correspond to physically distinct components. Blocks can be configured to perform various operations, e.g., by programming a processor or providing appropriate control circuitry, and various blocks might or might not be reconfigurable depending on how the initial configuration is obtained. Embodiments of the present invention can be realized in a variety of apparatus including electronic devices implemented using any combination of circuitry and software.

According to various embodiments, portable electronic device 200 (e.g., implementing portable electronic device 120 or 140) can provide time information for remote locations on a user interface (e.g., display 220) for a user. In some embodiments, portable electronic device 200 can automatically generate time information for remote locations individually or cooperatively with other devices, without requiring a user to specify which remote locations the user is interested in. The remote locations can be automatically identified or determined based on context information resident on portable electronic device 200 and/or context information available on one or more external devices that are accessible by portable electronic device 200. In some embodiments, the remote locations can be prioritized such that time information of the identified or determined remote locations can be provided to a user in an order based on the prioritization, and/or such that time information of only a subset of the identified or determined remote locations are made available to a user. The time information can be presented or otherwise provided to the user in response to receiving user input to access the time information, or in response to receiving user input invoking a functionality for which the time information may be useful to the user.

Figure 3:
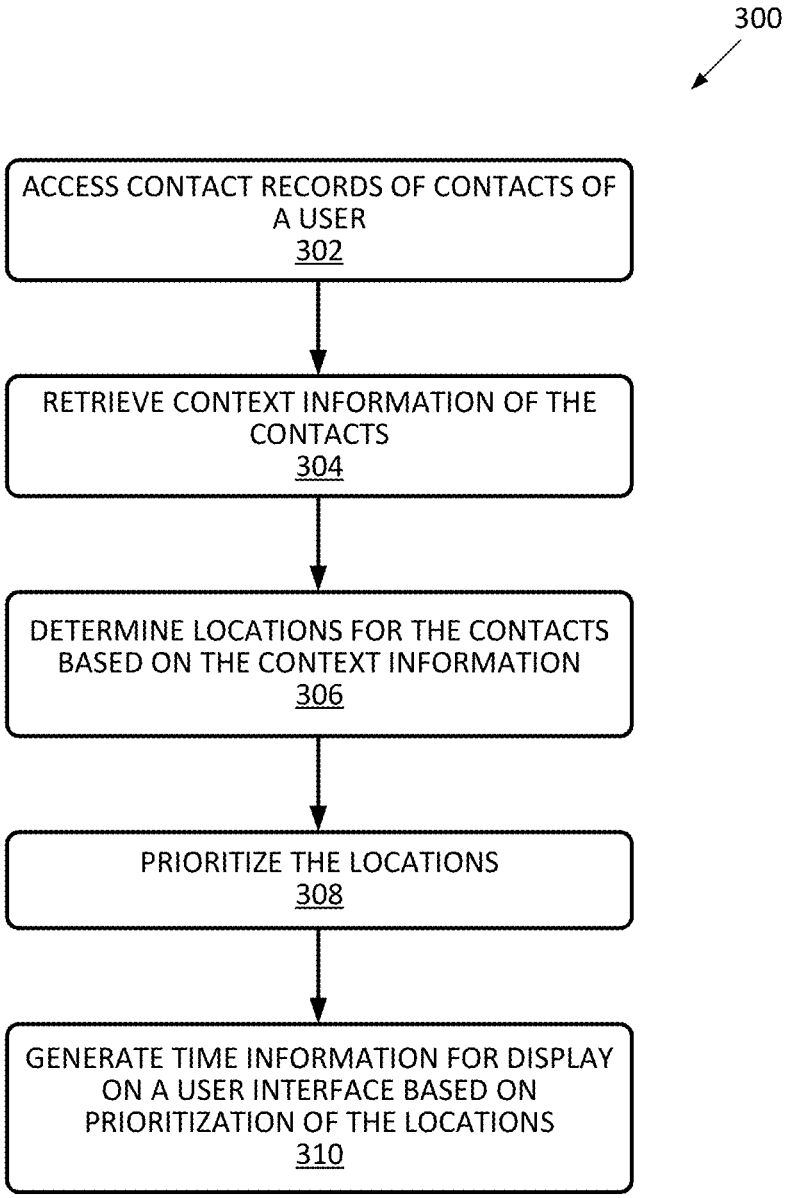
FIG. 3 illustrates a flow diagram of a process for automatic generation of time information according to some embodiments.

FIG. 3 illustrates a flow diagram of a process 300 for automatic generation of time information using context information relating to contacts of a user, according to some embodiments. The time information can be displayed, for example, on a user interface (e.g., display 220) of portable electronic device 200. Process 300 can be implemented, for example, as part of an operating system, as part of an application, or a combination thereof. In some embodiments, certain aspects of process 300 can be implemented in a separate device (e.g., a host device, a cloud storage device, etc.) that can be communicatively coupled with portable electronic device 200.

Initiation of process 300 can be triggered continuously, at a predetermined time interval (e.g., once a day, once a week, once a month, etc.), when user input to initiate the process is received, when new context information is available or an existing piece of context information is modified, when a new contact is added, when portable electronic device 200 detects communication connectivity with another device, when portable electronic device 200 changes or travels to a different location, and/or by any suitable manner. In some embodiments, the triggering mechanism and/or settings of the triggering mechanism (e.g., length of predetermined time interval) to initiate process 300 can be preset and/or be user configurable.

Process 300 can begin at block 302 by accessing the contact records of contacts (e.g., a contacts list) of a user of portable electronic device 200. In some embodiments, some or all of the contact records can be resident on portable electronic device 200, for example, as part of data stored on portable electronic device 200 by a personal information management application (e.g., contacts application such as an address book or phone book application, etc.), a communication application (e.g., email application, text messaging application, voice call application, instant messaging application, etc.), a social networking application, or the like. In some embodiments, some or all of the contact records can alternatively or additionally be stored on or be accessible via an external device such as a host device (e.g., portable electronic device 120) or a cloud storage device (e.g., cloud storage device 160).

Each or any of the contact records may contain contact information about a contact including any combination of a name, one or more addresses, one or more phone numbers, one or more email addresses, one or more screen names or usernames, etc. In some embodiments, a contact record may include a contact group that the particular contact belongs to. A contact group may be a user configurable group in which a user can assign individual contacts to the group, or may be an automatically generated group based on, for example, how recent or often a user communicates with the particular contact (e.g., as determined from call logs, email logs, text messaging logs, etc.). Examples of contact groups may include a favorites group, a family group, a very important people (VIP) group, a friends group, a co-workers group, an emergency contacts group, a client contacts group, a recently contacted group, a frequently contacted group, etc.

In some embodiments, instead of accessing the entire list of contacts available to portable electronic device 200, process 300 can access contact records that belong to one or more selected contact groups. For example, process 300 can access contact records of only contact groups that are most important or significant to a user, such as a family group, a favorites group, a VIP group, and/or a frequently contacted group, etc. By reducing the number of contact records that are accessed to only those contacts that may be most important or significant to a user, the amount of computing resources and processing time for process 300 can be reduced. Doing so may also reduce power consumption and extend the battery usage of portable electronic device 200.

At block 304, process 300 can retrieve context information of the contacts whose contact records were accessed at block 302. The context information can be unrestricted information or data relating to or about the contacts, or information or data relating to or about the contacts that a user has permission to access. Examples of context information may include contact information (e.g., phone number, address, etc.) from the contact records of one or more of the contacts. In some embodiments, the context information can include one or more communications to or from the user relating to the contacts. The communications can be retrieved by using one or more contact identifiers (e.g., a name, an email address, a phone number, a screen name or username, etc.) provided by the contact records. For example, the context information may include one or more communications between the user and a contact such as an email to or from the email address of the contact; a voice call, voicemail, or text message to or from a phone number of the contact; an instant message to or from a username of the contact, etc. In some embodiments, the communication need not be between the user and the contact, and may be a communication that includes content about a contact (e.g., an email in which the name of the contact was mentioned, etc.). In some embodiments, the context information may include application data relating to or about the contacts from one or more applications executable on or accessible from portable electronic device 200, such as application data from personal information management applications (e.g., calendar applications, etc.), productivity applications (e.g., document viewer or editor applications, etc.), travel applications (e.g., location sharing applications, mapping and navigation applications, travel planning and management applications, etc.), web browser applications, social networking applications, photo or imaging applications (including video), etc. For example, the application data may include a social networking page of a contact, location data being shared by a contact via a location sharing application, travel itinerary of a contact provided by a travel management application, a calendar or task entry involving a contact, a document containing content about a contact, a photo or video of a contact, a web page containing content about a contact, etc. It should be understood that these examples of context information are illustrative, and that other context information relating to or about the contacts can be used including information or data that includes or can be retrieved by using one or more contact identifiers.

In some embodiments, some or all of the context information can be resident on portable electronic device 200. Alternatively or additionally, some or all of the context information can be stored on or be accessible via an external device such as a host device (e.g., portable electronic device 120, a desktop or laptop computer, or the like) or a cloud storage device (e.g., cloud storage device 160). For example, the context information retrieved may include a text message stored on portable electronic device 200, an email stored on a host device communicatively coupled to portable electronic device 200, a photo stored on a cloud storage device communicatively coupled to portable electronic device 200, and/or content stored on a web server or other server computers accessible via portable electronic device 200 and/or via a host device communicatively coupled to portable electronic device 200. It should also be noted that one or more applications providing application data as context information need not be resident on portable electronic device 200. For example, an application can be resident on a host device, and application data from the application on the host device can be retrieved by invoking a functionality of the host device from portable electronic device 200.

At block 306, process 300 can determine or identify locations for the contacts based on the context information of the contacts. In some embodiments, the location for a contact can be determined or identified based on, for example, a location (e.g., a city) corresponding to the address, and/or to the area code of a phone number of a contact. The location for a contact can also be based on the content of a communication providing a location of a contact. For example, the content of an email from a contact may indicate that the contact is travelling to a particular city. The location for a contact can also be based on application data such as a location indicated on a social networking page or a web page of a contact, location being shared by a contact, location indicated in a travel itinerary, location of a meeting with a contact as indicated in a calendar or task entry, location of a contact mentioned in a document (e.g., address in a letterhead of a document), location where a photo or video of a contact was taken or recorded, etc. It should be understood that any combination of one or more pieces of context information can be used to determine or identify a location for a contact, and that each piece of context information may be used for multiple contacts if the piece of context information includes location information for multiple contacts.

According to some embodiments, because there may be a large amount of context information to analyze, to reduce the amount of context information to be analyzed on subsequent execution of process 300, context information that has already been analyzed once for location information can be tagged to indicate that the particular piece of context information need not be analyzed again unless the context information has changed. In case the context information has changed (e.g., a phone number of a contact record is modified), the piece of context information can be untagged such that subsequent execution of process 300 reevaluates the modified context information for updated location information.

In some embodiments, more than one location may be determined or identified for a contact. For example, the address of a contact may indicate the contact lives at a first location, but a communication from the contact states that the contact is currently on vacation at a second location. As such, location records with multiple locations per contact can be created and maintained for the contacts to keep track of the possible locations of the contacts.

FIG. 4 illustrates an example of a data structure for location records 400 according to some embodiments. Location records 400 may include, for each of the contacts 402, different location fields 404, 408, and 412 corresponding to different types of location, and respective confidence levels 406, 410, and 414 for each location. The confidence level provides an indication of the accuracy or the probability that the location determined for a contact is a correct location for that contact. For example, each location record may include a default location 404 for a contact, a current location 408 for a contact, and a future location 414 for a contact, and corresponding confidence levels for each type of location as shown. Although confidence levels 406, 410, and 414 are illustrated as being represented by a percentage, other representations can be used such as a ranking system of high, medium, and low confidences, etc. The confidence level for each location can be determined, for example, based on the type of context information being used to determine the location, the source of the context information, the timeliness or age of the context information, the number of corroborating pieces of context information, or other relevant factors as further described below. It should be noted that each type of location may use a different metric than other types of location for determining the confidence level. In some embodiments, if a contact has multiple possibilities for a particular type of location (e.g., multiple default locations), the location with the highest confidence level may be used. In some embodiments, each type of location may include more than one location for a contact (e.g., some or all of the multiple default locations and their respective confidence levels can be listed for a contact). In some embodiments, user input (e.g., to confirm the location or locations of a contact) may increase or decrease confidence levels. For instance, if time information for a particular location is shown as being associated with a particular contact, there may be an option for the user to provide input indicating the accuracy of the location as being a correct location for the contact, which would influence the confidence level.

The default location 404 for a contact may be a location (e.g., a city) based on the contact information indicated in the contact record of the contact (e.g., location corresponding to the area code of the contact's phone number, location corresponding to the address of the contact, etc.). The confidence level 406 for the default location 404 can be based on the type of contact information being used to determine the default location, the number of possible default locations, and/or the duration of time the contact has spent at the default location, etc. For example, the location corresponding to an address may be more reliable than the location corresponding to a mobile phone number because a mobile phone number can be freely used outside of the region of the area code of the mobile phone number. Thus, a default location based on a mobile phone number may have a lower confidence level that a default location based on an address. As another example, referring to the location record for the contact Ava in FIG. 4, suppose Ava has three phone numbers in which two phone numbers have a New York area code, and the third phone number has a Chicago area code. The default location for Ava may be determined to be New York with a confidence level of 66% because two of the three phone numbers for Ava have a New York area code.

In some embodiments, the default location 404 may be the location where the contact has spent the most time at since the location record was created. For example, suppose the location record for the contact Agnes was created a year ago, and a status on her social networking page indicates that she is currently attending university in San Francisco. Even though the phone number and address of Agnes may correspond to her home city of Seattle, the default location for Agnes can be set as San Francisco, for example, if Agnes has spent only one month in the past year in Seattle. The confidence level in such a scenario can be the percentage of time that Agnes has spent at the default location of San Francisco since the location record was created.

The current location 408 for a contact may be a location where the contact is most likely to be present at the current time. The confidence level 410 for the current location 408 can be based on the type and source of the context information being used to determine the current location, the number of corroborating pieces of context information, and/or the timeliness or age of the context information, etc. For example, referring to the location record for the contact Agnes in FIG. 4, suppose an email from Agnes attaching a photo of Agnes in London was received today, and a text message was received from Agnes stating that she has arrived in London. Because multiple corroborating pieces of context information indicate that Agnes is currently in London and the context information originated from Agnes, the confidence level that Agnes is currently in London may be 100%. As another example, instead of receiving an email and text message from Agnes, if a status on a social networking page of another friend indicates that the friend is on vacation with Agnes in London, the confidence level that Agnes is currently in London may be reduced because the source of the context information is from someone other than Agnes.

In some embodiments, the default location 404 of the contact may be used as the current location 408 of the contact, for example, if there is a lack of recent information available indicating the current location of the contact. In such scenarios, the confidence level 410 of the current location 408 may be based on, for example, the last time the user has communicated with the contact at the default location. For example, referring to the location records of the contacts Aunt Grace and Dad. Suppose the user has not communicated with Aunt Grace for six months, and has not communicated with Dad for two weeks. The confidence level that Aunt Grace may currently be at her default location of London may be 50% whereas the confidence level that Dad may currently be at his default location may be 90%, because the user has communicated with Dad more recently that Aunt Grace.

In some embodiments, ancillary information available from the context information may be used to determine the current location 408 of a contact. For example, a language spoken in the background of a voice call with a contact may indicate that the contact is in a foreign country, or conversations between third parties in the background of a voice call discussing a particular landmark may be used to determine the current location of a contact. A current location determined from such ancillary information may be given a lower confidence level than an express or explicit indication of the current location.

Future location 412 for a contact may be used to track where the contact may be at a future time. For example, referring again to the location record for Agnes in FIG. 4, suppose Agnes has provided in an email an itinerary of her vacation in London indicating that she will return to San Francisco next week. In such a scenario, the location record for Agnes may indicate her future location as San Francisco. As another example, suppose a calendar entry indicates that Dad will be attending a conference in Paris next month. In such a scenario, the location record for Dad may indicate his future location as Paris. In some embodiments, the future location may have a date or a range of dates (not shown) associated with the future location indicating when the contact will likely be at the future location, and the current location for the contact can be updated with the future location when the date of the future location arrives. The confidence level 414 for the future location 412 may be determined similar to the current location. It should be noted that not all contacts may have a future location if no context information indicating a future location for the contact is available. For example, as shown in FIG. 4, the location records for contacts Aunt Grace and Ava do not have a future location indicating that there is a lack of context information providing such information. In some embodiments, the default location of a contact can be used as the future location.

It should be noted that although contact records 400 are shown with three types of location defined (default, current, and future), in other embodiments, fewer or more types of location can be used. Furthermore, although location records 400 have been described as having just one location for each type of location (e.g., the most likely location or location with highest confidence level for the particular type of location), in other embodiments, there may be multiple locations included for each type of location, and each of the multiple locations within each type may have a corresponding confidence level. For example, a contact may have multiple default locations if the phone number of a contact corresponds to a first location and the address of the contact corresponds to a second location, and different confidence levels for the two default locations can be determined. As another example, if the travel itinerary of a contact indicates a multi-leg trip to multiple cities, multiple future locations can be listed for the contact. It should also be understood the that metrics for determining the confidence level of a location described above are illustrative, and that other embodiments may use different metrics or factors to determine the confidence level for each type of location.

Referring back to FIG. 3, having determined or identified the locations for the contacts, process 300 can prioritize the determined or identified locations at block 308, for example, according to how useful or significant the time information for the locations may be to a user. In some embodiments, the prioritization can be performed collectively on all the different types of location (e.g., default location, current location, future location, etc.) for the contacts. In some embodiments, the prioritization can be performed on a subset of the different types of location, for example, only on the current locations, or only on the current and future locations, etc. Furthermore, in some embodiments, only remote locations that are outside of the geographical area of the current location of the user are considered, although the current location of the user may also be considered in other embodiments. Thus, in some embodiments, the locations determined or identified from block 306 may be filtered down to a set of remote locations. For example, the prioritization can be performed on only those of the locations that are outside of the city where the user is currently located, or on only those of the locations having a different time zone than the time zone of the current location of the user. The current location of the user can be determined, for example, by a GPS receiver or other location tracking mechanism of portable electronic device 200.

For ease of explanation, as used hereinafter, the term "locations" or "location" may refer to both embodiments in which only remote locations are considered and embodiments in which the current location of the user is also considered, and the term "remote locations" or "remote location" may refer to embodiments in which only remote locations are considered.

The locations determined or identified at block 306 can be prioritized at block 308 based on a combination of one or more factors. For example, the prioritization can be based on, for each location, the number of contacts corresponding to the location, a frequency of communication between the user and each of the contacts corresponding to the location, an amount of time that has elapsed since the last communication between the user and each of the contacts corresponding to the location, a relationship between the user and each of the contacts corresponding to the location, the confidence level that the location determined for the contacts corresponding to the location is a correct or accurate location for that contact, etc. In some embodiments, a numeric rank score can be determined for each location based on one or more of the factors. For example, in some embodiments, a baseline score can be given for each of the contacts corresponding to a location. For each of the contacts corresponding to a location, the baseline score can be scaled, increased, and/or decreased based on scaling factors or numeric values corresponding to a frequency of communication between the user and the contact, an amount of time that has elapsed since the last communication between the user and the contact, and/or a relationship between and the user and the contact, etc. The adjusted baseline score can then be scaled by the confidence level that the location is an accurate location for the contact to generate a resulting score corresponding to the contact for that location. The resulting scores for all the contacts at a location can then be combined, for example, summed or averaged, to derive the numeric rank score for the location.

As an illustrative example, a baseline score of 100 can be given for each contact corresponding to a location. A numeric value indicating the number of times the user has communicated with the contact in the past month can be added to the baseline score. If the user last communicated with the contact within the last week, within the last month, within the last six months, or within the last year, respective numeric values of 20, 15, 10 and 5 can be added to the baseline score. If the user last communicated with the contact more than a year ago, a numeric value of 20 can be deducted from the baseline score. A scaling factor of 1.3 can be applied if the contact is a family member of the user (e.g., as indicated by the contact belonging to a contact group), or a scaling factor of 1.2 can be applied if the contact belongs to a VIP contact group of the user, etc. The adjusted baseline score can then be scaled by the confidence level percentage.

Following the above example, to further illustrate the computation of a rank score according to some embodiments, an example of computing a score for the current location of San Francisco for the contact Dad will now be described with reference to FIG. 4. The computation begins with a baseline score of 100. Suppose the user has communicated with Dad twelve times in the past month; the numeric value of 12 is added to the baseline score of 100. Suppose further that the user has last communicated with Dad within the last month; a numeric value of 15 is added to 112 derive the value 117. Because Dad is a family member of the user, the value 117 is scaled by a scaling factor of 1.3 to derive an adjusted baseline score of 152. The adjusted baseline score can then be multiplied by 0.90 representing the confidence level percentage that San Francisco is the correct current location for Dad to derive a resulting score of 137. A similar computation process can be performed for each location field indicating San Francisco as the location, and the resulting scores can be summed to derive the numeric rank score for San Francisco. The rank scores for the locations can then be used to prioritize the locations.

FIG. 5 illustrates a prioritized list of locations 500 including time information for the locations, according to various embodiments. The prioritized list of locations 500 includes a list of locations 502 arranged in the order of their rank scores. The prioritized list of locations 500 also includes time zones 504 as the time information corresponding to each location. In some embodiments, the local time for each location can additionally or alternatively be included. The prioritized list of locations 500 can also include rank scores 508 for the locations, and contacts 506 who may currently be present at each of the locations (e.g., according to the location records of the contacts).

In other embodiments, other baseline scores, scaling factors, numeric values, and/or other computation algorithms can be used to calculate the numeric rank score of a location. For example, in some embodiments, the numeric rank score can be computed without scaling factors, and the numeric rank score is derived from a summation of various numeric values. The locations can then be prioritized in the order of the rank scores, in which the location with the highest rank score is prioritized first. In other embodiments, other ranking or prioritization mechanism can be used in place of a numeric rank score.

According to some embodiments, instead of generating a numeric rank score by city as described above, the locations can be grouped by time zone into a set of time zones, and the prioritization can be performed on the set of time zones. For example, locations such as San Francisco and Las Vegas that share the same time zone can be grouped together as a Pacific Daylight Time (PDT) time zone, and a numeric rank score can be determined for the PDT time zone. The rank score for a time zone can be calculated using algorithms similar to any of those described above. In some embodiments, the numeric ranks score for each city in the time zone can be combined, for example, summed or averaged, to derive the rank score for the time zone. The rank scores for the time zones can then be used to prioritize the time zones.

FIG. 6 illustrates a prioritized list of time zones 600, according to various embodiments. The prioritized list of time zones 600 includes a list of time zones 602 arranged in the order of their rank scores. The prioritized list of time zones 600 can include locations 604 corresponding to each time zone. In some embodiments, the local time for each location can also be included. The prioritized list of time zones 600 can also include additional information such as contacts 606 whose local time may correspond to the time zone (e.g., as determined from the location records), rank scores 608 for the time zones, etc.

Referring back to FIG. 3, process 300 continues with block 310. At block 310, process 300 can generate time information for display on a user interface (e.g., on display 220 of portable electronic device 200) based on the prioritization of the locations performed at block 308. In some embodiments, the time information can include a time zone and/or a local time corresponding to each location. The time information can be included in a prioritized list of locations or times zones arranged in the order of priority according to their rank scores (e.g., with the highest ranked location or time zone being the highest priority). In some embodiments, the prioritized list can include all the locations or time zones that were considered by the prioritization operation performed at block 306. In some embodiments, the prioritized list may include only a subset of the locations or time zones (e.g., 2, 4, 10, etc. of the highest priority or ranked locations or time zones). In some embodiments, the number of locations or time zones included in the prioritized list may be user configurable and/or may depend on the capabilities of portable electronic device 200 (e.g., a screen resolution and/or size of display 220 of portable electronic device 200). The prioritized list of locations or time zones may also include additional information such as their respective rank scores, contacts who are currently at the location or time zone, etc.

Subsequent to the generation of the time information based on the prioritization of locations, a representation of the generated time information can be displayed or presented for a user on a user interface of portable electronic device 200. In some embodiments, the time information can be stored on portable electronic device 200 or be stored on a separate device (e.g., a host device or cloud storage device), and the time information can be retrieved at a later time for display to a user. For example, in some embodiments, process 300 can be executed at power up or boot up of portable electronic device 200, and the generated time information need not be displayed immediately. The generated time information can be stored, and the generated time information can be retrieved at some later time in response to receiving user input to display the time information.

Figure 7:
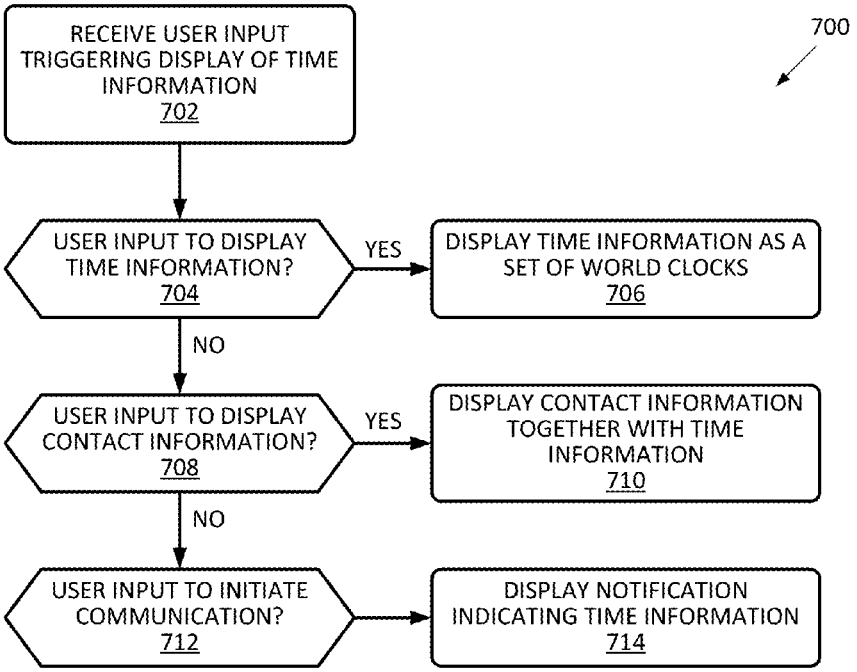
FIG. 7 illustrates a flow diagram of a process for displaying time information according to some embodiments.

FIG. 7 illustrates a flow diagram of a process 700 for displaying time information on a user interface (e.g., on display 220 of portable electronic device 200), according to some embodiments. Process 700 begins at block 702 at which user input triggering the display of time information can be received by the portable electronic device. In some embodiments, the user input can be a command to request a functionality to display time information or contact information, a command to request a functionality to initiate a communication with one or more contacts, or other commands that may involve the display of time information to a user. The user input can be in the form of a contact-based input in which the user touches or otherwise physically engages with a user interface such as a touchscreen or one or more buttons, etc. In some embodiments, the user input can be a contactless input such as a voice command, or a motion that does involve contact with portable electronic device 200 (e.g., a wave of a hand over portable electronic device, etc.). It should be understood that the user input can also include a sequence of contact-based inputs (e.g., sequence of taps navigating through menus on a user interface, etc.), a sequence of contactless inputs (e.g., sequence of spoken words, etc.), or any combination thereof.

In response to receiving the user input, the time information generated by process 300 can be retrieved, or if the time information is unavailable or is out of date (e.g., if new context information are available since the last time the time information was generated, if a new contact has been added, or if a predetermined time has elapsed since the time information was generated, etc.), process 300 can be executed to generate the time information. Process 700 then continues at block 704 to determine the functionality that is being requested by the user input.

At block 704, process 700 can determine whether the user input is requesting a functionality to display the time information generated by process 300. For example, the user input may be a command to access a world clock application to display the time information. As another example, if the time information is set to be displayed on the home menu or the background of the user interface of portable electronic device 200, the user input may be a command that unlocks or otherwise activates the home screen of portable electronic device 200.

When it is determined that the user input is requesting a functionality to display the time information, in some embodiments, process 700 can display the time information as a set of one or more world clocks corresponding to their respective locations on the user interface of portable electronic device 200. One or more world clocks can be displayed simultaneously on the user interface. The number of world clocks being displayed simultaneously may be dependent on the capabilities of portable electronic device 200. For example, if the display resolution of the user interface can support three world clocks to be displayed simultaneously, up to three world clocks can be displayed concurrently on the user interface. In some embodiments, the number of world clocks being displayed simultaneously may alternatively or additionally be dependent on user configuration. The set of one or more world clocks can be displayed according to the prioritization of their respective locations. For example, the world clock of the highest priority location can be displayed first or be displayed at the top, followed by the other world clocks in order of their respective rank scores. In some embodiments, in addition to time information, additional geolocation information such as the local weather, news headlines, and/or other information can also be displayed.

Figure 8:
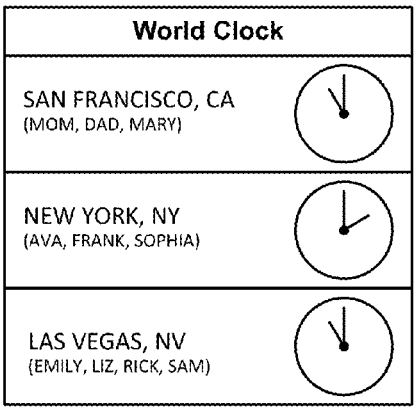
FIG. 8 illustrates an example of time information being displayed on a user interface according to some embodiments.
Figure 9:
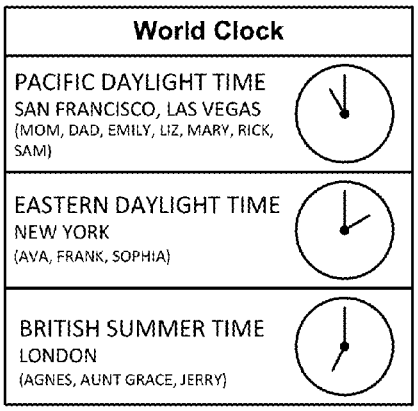
FIG. 9 illustrates another example of time information being displayed on a user interface according to some embodiments.

FIGS. 8-9 illustrate examples of various embodiments of a set of one or more world clocks representing time information generated by process 300 being displayed on a user interface. The world clocks can be presented as analog clocks as shown, as digital clocks, or in any suitable form. FIG. 8 shows a set of world clocks being displayed according to city locations based on the rank scores shown in FIG. 5. In the embodiment shown, the user interface may support up to three world clocks to be displayed simultaneously. In the example of FIG. 5, of the various city locations, San Francisco has the highest rank score, followed by New York and Las Vegas. Thus, as shown, the world clock representing the local time of San Francisco is displayed at the top, followed by New York and Las Vegas according to the order of their respective rank scores.

In some embodiments, the world clocks can be displayed together with additional information about their respective locations. For example, for each world clock, a list of contacts that may currently be at the corresponding location can be displayed as shown in FIG. 8. In some embodiments, the number of contacts that are displayed may depend on the length of the contact names and how many of the contact names can be displayed in a legible size. The contacts can be listed according to how significant or important the contact is to the user such that the most important or significant contacts are listed first. The determination as to how significant or important the contact is to the user can be made based on the contact group that the contact belongs to, the frequency of communication between the contact and the user, the length of time that has elapsed since the user last communicated with the contact, etc. In some embodiments, the world clocks can also be displayed with time zone information, a time difference between the respective locations and the current location of the user, day of the week, and/or other information about the respective locations, etc.

Referring now to FIG. 9, the set of world clocks can also be displayed according to time zones; an example using the time zone rankings of FIG. 6 is shown. In the embodiment shown, similar to FIG. 8, the user interface may support up to three world clocks to be displayed simultaneously. In the example of FIG. 6, of the various time zones, Pacific Daylight Time (PDT) has the highest rank score, followed by Eastern Daylight Time (EDT) and British Summer Time (BST). Thus, as shown, the world clock representing the PDT time zone is displayed at the top, followed by the EDT and BST time zones according to the order of their respective rank scores. In some embodiments, the world clocks can be displayed with additional information about the respective time zones. For example, additional information such as a list of city locations belonging to each time zone, a list of contacts that may currently be at a location corresponding to the time zone, and any of the relevant information described above can displayed.

In some embodiments, the locations or time zones that were prioritized by process 300 may include only remote locations outside the current location or current time zone of the user. In such scenarios, the set of world clocks can be displayed without a world clock representing the current location or time zone of the user. Alternatively, a world clock representing the current location or time zone of the user can be added, for example, at the top of the list. In embodiments in which the current location or current time zone of the user was considered by the prioritization performed by process 300, a world clock representing the current location or time zone of the user can be displayed according to its ranking or priority, or be displayed, for example, at the top of the list.

In some embodiments, because the display resolution or size of the user interface may be limited, the user interface may not be able to accommodate the concurrent display of the entire set of world clocks of interest. In such embodiments, the set of world clocks can be presented as a scrollable list of world clocks, and a user can provide user input to scroll through the list to display additional world clocks on the user interface.

In some embodiments, the one or more world clocks being displayed can be selected based on user input such as a voice command to display a world clock for a particular location. For example, a user may speak the words "time in San Francisco." A voice recognition application executing on portable electronic device 200 can recognize the spoken words as a command to display the local time for San Francisco, and the world clock for San Francisco can be displayed on the user interface. In such embodiments, the locations or time zones of which time information was generated by process 300 can be used as a limited dictionary of locations or time zones of interest to a user to improve the performance of the voice recognition application. For example, instead of having to decipher the spoken location against tens of thousands of possible cities around the world, the voice recognition application can compare the spoken location with a reduced set of locations as determined or identified by process 300 or similar processes. In this manner, the accuracy and the speed at which the voice recognition application can properly determine the location or time zone that the user is requesting can be improved.

Referring back to FIG. 7, if the user input received at block 702 is not a request to display time information, then at block 708, process 700 can determine whether the user input is requesting a functionality to display contact information for one or more of the contacts. For example, the user input may be a command to display a list of contacts of the user (e.g., from a contacts application), etc. As another example, the user input may be a tap on a name of a contact in a text message to display contact information such as the phone number and address of that contact, etc.

When it is determined that the user input is requesting a functionality to display contact information, at block 710, process 700 can display the requested contact information for one or more of the contacts together with time information for the contacts on the user interface of portable electronic device 200. For example, if the user input is requesting a list of contacts to be displayed, the list of contacts can be displayed with additional information indicating the local time or a time of day for each of the contacts.

Figure 10:
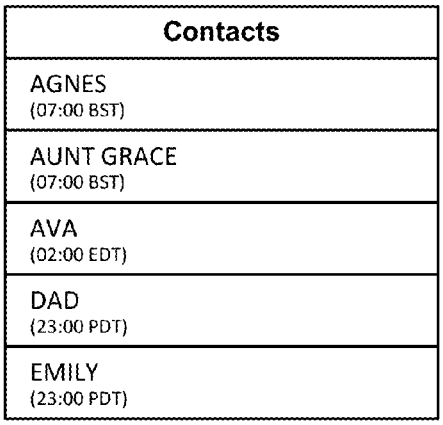
FIG. 10 illustrates an example of contact information being displayed on a user interface according to some embodiments.
Figure 11:
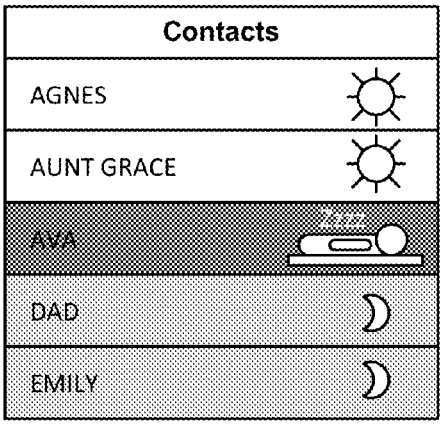
FIG. 11 illustrates another example of contact information being displayed on a user interface according to some embodiments.

FIGS. 10-11 illustrate examples of various embodiments of a list of contacts being displayed on a user interface. In the embodiment shown, the user interface may support up to five contacts to be displayed simultaneously. Additional contacts can be displayed, for example, by scrolling through the list of contacts. FIG. 10 shows a list of contacts being displayed on a user interface together with the local time and time zone of the current location for each of the contacts, according to some embodiments. In some embodiments, additional information for each of the contacts can also be displayed. For example, each contact may also be listed together with geolocation information such as the current city location of contact, the weather at that location, news headlines or alerts for that location, etc. As another example, a calendar entry for the contact corresponding to the local time of the contact can also be displayed.

FIG. 11 shows a list of contacts being displayed on a user interface together with a color and/or an icon indicating the time of day at the current location for each of the contacts, according to some embodiments. The time of a day can be divided up into different segments of time indicating the chronology of a day and/or human activity during a day. For example, in some embodiments, the hours between 6:00 am to 6:00 pm can be part of a daytime segment, the hours between 6:00 pm and midnight can be part of an evening segment, and the hours between midnight and 6:00 am can be part of a nighttime segment during which a contact may likely be asleep. The listing of contacts can be displayed together with a color and/or an icon representing the time of day for each of the contacts. In other embodiments, different hours of the day can be set for the different segments of time, and each contact may have a different mapping of hours to a segment of time.

As an example of displaying a color and/or icon indicating the time of day, suppose the local time in London is 7:00 am. The background color of the contact entry for Agnes, whose current location is London, can be shown in a light color together with an icon of a sun indicating that it is daytime in London. As another example, suppose the local time in New York is 2:00 am. The background color of the contact entry for Ava, whose current location is New York, can be shown in a dark color together with an icon of a person sleeping indicating that it is nighttime in New York and that Ava may be sleeping at this time. As a further example, suppose the local time in San Francisco is 11:00 pm. The background color of the contact entry for Dad, whose current location is San Francisco, can be shown in a medium color together with an icon of a moon indicating that it is evening in San Francisco.

It should be understood that other segments of time representing the chronology of a day and/or human activity during a day can also be used. For example, additional segments of time can be defined for work hours, lunch time, dinner time, sunset, sunrise, dawn, dusk, twilight, etc. Furthermore, it should be understood that other colors and/or icons representing each segment of time of a day can be used, and that the color representing the segment of time of a day can be displayed in any number of ways. For example, instead of the background color, the font color of the name of a contact can be displayed in the color corresponding to the time of day, etc. The embodiments of FIGS. 10 and 11 can also be combined such that each of the contacts is displayed with any combination of local time, color, and/or an icon representing the time of day, along with additional geolocation information described herein. Although the examples above have been described with respect to displaying a list of contacts, any combination of the above can also be displayed when accessing a contact record of a contact. For example, the local time of a contact can be displayed together with the phone number and address of the contact when the contact record is displayed on the user interface of portable electronic device 200.

Referring back to FIG. 7, if the user input received at block 702 is not a request to display time information or contact information, then at block 712, process 700 can determine that the user input is requesting a function to initiate communication with one or more of the contacts. For example, the user input may be a command to initiate a phone call with a contact, etc. As another example, the user input may be a command to send a text message to multiple contacts, etc.

Figure 12:
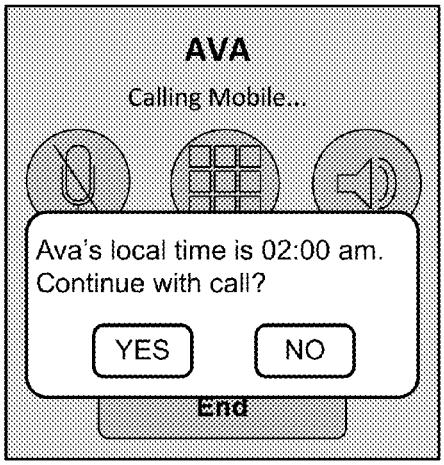
FIG. 12 illustrates an example of a notification including time information being displayed on a user interface according to some embodiments.

When it is determined that the user input is requesting a function to initiate a communication with one or more of the contacts, at block 714, process 700 can display a notification indicating the time information for the one or more of the contacts. In some embodiments, the notification can include a message indicating the local time of a contact. FIG. 12 shows a notification indicating time information for a contact being displayed on a user interface in response to receiving user input to initiate communication with a contact, according to some embodiments. For example, suppose user input requesting initiation of a voice call with the contact Ava is received. In response to receiving this user input, a notification indicating time information (e.g., the local time, time of day, etc.) for Ava can be displayed. The notification may include, for example, the message: "Ava's local time is 02:00 am." In some embodiments, additional information about the current location of the contact such as any of the geolocation information described herein (e.g., weather, news headlines, etc.) can also be displayed as part of the notification. In some embodiments, the notification may also include a prompt requesting confirmation from the user to proceed with the communication. For example, the notification may request the user to provide user input indicating whether the voice call with Ava should proceed. In some embodiments, the notification can be displayed selectively only when the local time of a contact is determined to be likely to be an inconvenient time for that contact (e.g., bedtime, during a meeting as indicated by a calendar entry, etc.). Thus, for example, if the user is attempting to initiate a voice call with a contact who is currently at a daytime location, the notification need not be displayed.

In some embodiments, in response to receiving user input to initiate communication with the contact, a location request can be sent from portable electronic device 200 (or from a host device) to a communication device of the contact (e.g., a mobile phone of the contact, etc.) to request the current location of the contact. If the user has been given permission to access the current location of the contact from the contact's communication device, the contact's communication device may send its current location to portable electronic device 200. Portable electronic device 200 may generate time information based on the current location of the contact as received from the contact's communication device, and display the time information (e.g., local time of the contact) as part of a notification before portable electronic device 200 proceeds with the user requested communication.

It should be understood that although process 700 has been described in a particular order for determining the particular function that the user input is requesting (e.g., to display time information, to display contact information, to initiate a communication with a contact, etc.), process 700 can be performed in any suitable order. Moreover, in other embodiments, other functions that may trigger time information to be displayed can also be included in process 700 in addition to or instead of the examples described.

Figure 13:
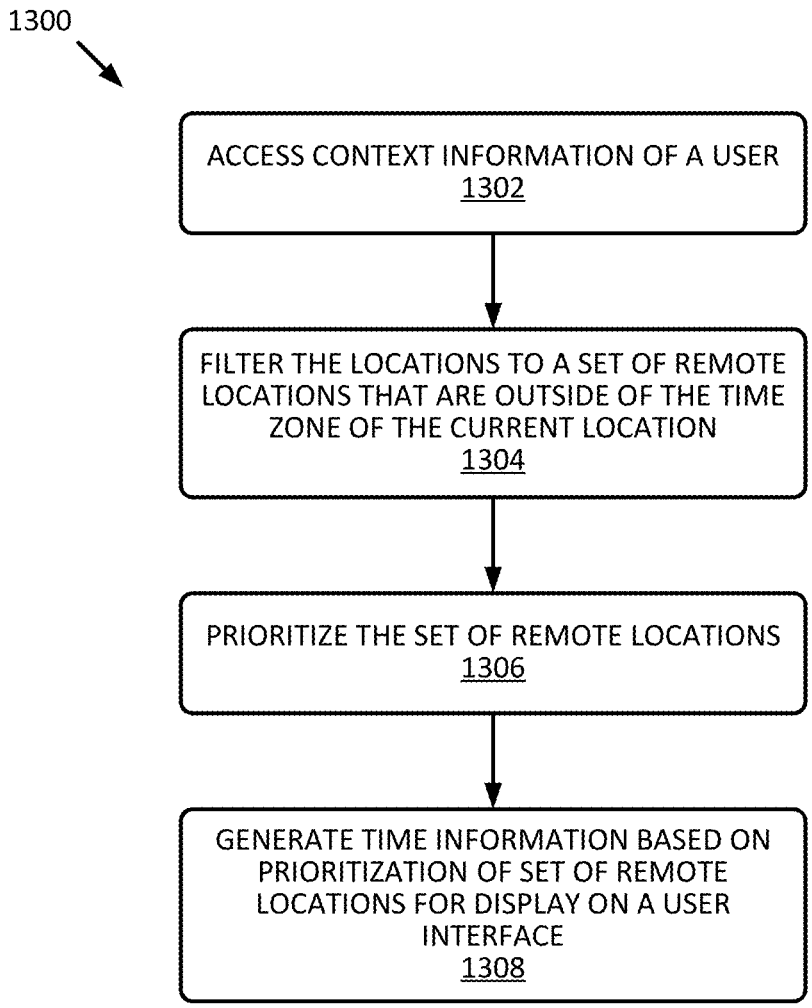
FIG. 13 illustrates a flow diagram of another process for automatic generation of time information according to some embodiments.

FIG. 13 illustrates a flow diagram of a process 1300 for automatic generation of time information using context information of a user, according to some embodiments. The time information can be displayed, for example, on a user interface of portable electronic device 200. In some embodiments, certain aspects of process 1300 can be implemented in a separate device (e.g., a host device, a cloud storage device, etc.) that may be communicatively coupled with portable electronic device 200. It should also be noted that certain aspects of process 1300 may be similar to process 300 described above, a detailed description of which need not be repeated.

Initiation of process 1300 can be triggered continuously, at a predetermined time interval (e.g., once a day, once a week, once a month, etc.), when a user input to initiate the process is received, when new context information is available or an existing piece of context information is modified, when portable electronic device 200 detects communication connectivity with another device, when portable electronic device 200 changes or travels to a different location, and/or by any suitable manner. In some embodiments, the triggering mechanism and/or settings of the triggering mechanism (e.g., length of predetermined time interval) to initiate process 1300 can be preset and/or be user configurable.

Process 1300 can begin at block 1302 by accessing context information of the user. The context information can be information or data relating to or about the user that may provide an indication of one or more locations that may be of interest to a user. For example, the context information may include a device location history of portable electronic device 200. The device location history can be generated and maintained by portable electronic device 200 as the user travels to different locations with portable electronic device 200. The locations recorded in the device location history can be determined by a GPS receiver or other location tracking mechanism of portable electronic device 200. The device location history may also include an indication of when the device was at each location (e.g., time stamps indicating the time and date that the device was at each location, etc.). In some embodiments, the context information can include one or more communications to or from the user indicating one or more locations of interest to the user. For example, the communication may be a text message between the user and a friend discussing a trip to a particular location, etc. As another example, the communication can be an email from an airline company or travel agency providing confirmation of the purchase of a plane ticket to a particular location, etc. In some embodiments, the context information can include application data indicating one or more locations of interest to the user from one or more applications executable on or accessible from portable electronic device 200, such as application data from personal information management applications (e.g., calendar applications, etc.), productivity applications (e.g., document viewer or editor applications, etc.), travel applications (e.g., directory assistance applications, mapping and navigation applications, travel planning and management applications, etc.), web browser applications, social networking applications, photo or imaging applications (including video), etc. For example, the application data may include directory assistance inquiries about a location, mapping requests, searches conducted by the user relating to a location, a social networking page of the user indicating location information, travel itinerary of the user, a calendar or task entry involving the user, a document or web page relating a location viewed by the user, a photo or video taken at a location by the user, etc. It should be understood that these examples of context information are illustrative, and that other context information indicating one or more locations of interest for the user can be used.

In some embodiments, some or all of the context information of the user can be resident on portable electronic device 200. Alternatively or additionally, some or all of the context information of the user can be stored on or be accessible via an external device such as a host device (e.g., portable electronic device 120) or a cloud storage device (e.g., cloud storage device 160). For example, the context information accessed may include a text message stored on portable electronic device 200, an email stored on a host device communicatively coupled to portable electronic device 200, a photo stored on a cloud storage device communicatively coupled to portable electronic device 200, and/or content stored on a web server or other server computers accessible via portable electronic device 200 and/or via a host device communicatively coupled to portable electronic device 200. It should also be noted that one or more applications providing application data as context information of the user need not be resident on portable electronic device 200. For example, an application can be resident on a host device, and application data from the application on the host device can be retrieved by invoking a functionality of the host device from portable electronic device 200.

At block 1304, process 1300 can filter the locations provided by the context information of the user down to a set of remote locations that are outside of the city or time zone of the current location of the user. The current location of the user can be assumed to be the current location of portable electronic device 200 as determined by a GPS receiver or other location tracking mechanism of portable electronic device 200.

Process 1300 can continue at block 1306 to prioritize the set of remote locations. The remote locations can be prioritized based on a combination of one or more factors. For example, the prioritization can be based on the number of pieces of context information corresponding to each remote location, a frequency of the user accessing the context information corresponding to each remote location, an amount of time that has elapsed since the user last accessed the context information corresponding to each remote location, the length of time the user has spent at the remote location in the past, the type of context information indicating the remote location, etc. For example, a remote location as indicated in a travel itinerary of the user may be given a higher priority than a location that was mentioned in a web page that the user has viewed, etc. In some embodiments, similar to process 300, a numeric rank score can be determined for each remote location to facilitate the prioritization of the remote locations. Furthermore, in some embodiments, the remote locations can be grouped by time zone into a set of remote time zones, and the prioritization can be performed on the set of remote time zones.

At block 1308, process 1300 can generate time information for display on a user interface (e.g., on a screen of portable electronic device 200) based on the prioritization of the set of remote locations performed at block 1306. In some embodiments, the time information can include a time zone and/or a local time corresponding to each remote location. The time information can be part of a prioritized list of remote locations or times zones arranged in the order of priority or rank scores (e.g. with the highest priority or highest ranked remote location or time zone arranged at the top of the list). In some embodiments, the prioritized list can include all the remote locations that were considered by the prioritization performed at block 1306. In some embodiments, the prioritized list may include only 2, 4, 10, etc. of the highest priority or ranking remote locations or time zones. In some embodiments, the number of remote locations included in the prioritized list may be user configurable and/or may depend on the capabilities of portable electronic device 200 (e.g., a display resolution of a user interface of portable electronic device 200).

Subsequent to the generation of the time information based on the prioritization of the set of remote locations, a representation of the time information can be displayed or presented for a user on a user interface of portable electronic device 200. In some embodiments, the time information can be stored on portable electronic device 200 or be stored on a separate device (e.g., a host device or cloud storage device), and the time information can be retrieved for display to a user at a later time. For example, in some embodiments, process 1300 can be executed at power up or boot up of portable electronic device 200, and the generated time information need not be displayed immediately. The generated time information can be stored and displayed, for example, after a user provides user input to access or display the time information at a later time. The time information can be displayed as a set of world clocks similar to the description provided above with reference to process 300.

In some embodiments, certain aspects of processes 300 and 1300 can be combined. For example, the locations determined or identified based on context information of the contacts of a user from process 300 can be combined with the remote locations indicated by context information of the user from proves 1300. The combined set of locations can be prioritized using techniques similar to those described herein, and time information based on the prioritization of the combined set of locations can be generated for display on a user interface.

The foregoing description may make reference to specific examples of a portable electronic device (e.g., a wearable electronic device, a handheld electronic device, etc.). It is to be understood that these examples are illustrative and not limiting; other devices can be substituted and can implement similar functional blocks and/or algorithms to perform operations described herein and/or other operations.

Embodiments of the present invention, e.g., in methods, apparatus, computer readable media and the like, can be realized using any combination of dedicated components and/or programmable processors and/or other programmable devices. The various processes described herein can be implemented on the same processor or different processors in any combination. Where components are described as being configured to perform certain operations, such configuration can be accomplished, e.g., by designing electronic circuits to perform the operation, by programming programmable electronic circuits (such as microprocessors) to perform the operation, or any combination thereof. Further, while the embodiments described above may make reference to specific hardware and software components, those skilled in the art will appreciate that different combinations of hardware and/or software components may also be used and that particular operations described as being implemented in hardware might also be implemented in software or vice versa.

Computer programs incorporating various features of the present invention may be encoded and stored on various computer readable storage media; suitable media include magnetic disk or tape, optical storage media such as compact disk (CD) or DVD (digital versatile disk), flash memory, and other non-transitory media. Computer readable media encoded with the program code may be packaged with a compatible electronic device, or the program code may be provided separately from electronic devices (e.g., via Internet download or as a separately packaged computer readable storage medium).

Thus, although the invention has been described with respect to specific embodiments, it will be appreciated that the invention is intended to cover all modifications and equivalents within the scope of the following claims.

What is claimed is:

1. A method for automatic generation of time information for display on a user interface, the method comprising:

accessing, by an electronic device, contact records of user contacts of the electronic device;

determining, by the electronic device, a plurality of locations for the user contacts based on context information of the contact records, wherein a prioritization of the plurality of locations is determined based at least in part on the context information; and generating, by the electronic device, the time information for display on the user interface based on the prioritization of the plurality of locations, wherein displaying the time information includes:

in accordance with a determination that a first location associated with a first subset of the user contacts has a first prioritization determined based on communications associated with a plurality of contacts in the first subset of the user contacts and a second location associated with a second subset of the user contacts has a second prioritization determined based on communications associated with a plurality of contacts in the second subset of the user contacts:

displaying a current time at the first location in a first region of the display; and displaying a current time at the second location in a second region of the display; and in accordance with a determination that the first location has the first prioritization determined based on communications associated with the plurality of contacts in the first subset of the user contacts and a third location, different from the second location and associated with a third subset of the user contacts, has the second prioritization determined based on communications associated with a plurality of contacts in the third subset of the user contacts:

displaying the current time at the first location in the first region of the display; and displaying a current time at the third location in the second region of the display, wherein the current time at any one location is displayed in not more than one region of the display.

2. The method of claim 1 further comprising:

displaying, together with the current time associated with a given one of the plurality of locations, names of at least two user contacts in the subset of the user contacts associated with the given one of the plurality of locations.

3. The method of claim 1, wherein the plurality of locations includes at least one remote location having a different time zone than a time zone of a current user location.

4. The method of claim 3, wherein the time information is generated for the remote locations without requiring user input specifying the remote locations.

5. The method of claim 1, wherein the plurality of locations are prioritized based on one or more of:

a number of user contacts corresponding to each location;

a frequency of communication between the user and each of the user contacts corresponding to each location;

an amount of time that has elapsed since the last communication between the user and each of the user contacts corresponding to each location;

a relationship between the user and each of the user contacts corresponding to each location; or a confidence level that each location determined for the user contacts is an accurate location for the corresponding user contact.

6. The method of claim 1, wherein prioritizing the plurality of locations includes:

grouping the plurality of locations by time zone into a set of time zones; and prioritizing the set of time zones.

7. The method of claim 1, wherein the context information of the contact records includes one or more of:

contact information for one or more of the user contacts;

one or more communications indicating one or more of the plurality of locations for the user contacts; and application data indicating one or more of the plurality of locations for the user contacts.

8. The method of claim 1, wherein the contact records are part of a contact group.

9. The method of claim 8, wherein the contact group is one of a favorites group, a family group, a Very Important People (VIP) group, a recently contacted contacts group, or a frequently contacted contacts group.

10. The method of claim 1, further comprising:

receiving user input to display the time information; and displaying, on the user interface, the time information as a set of one or more world clocks corresponding to one or more of the plurality of locations, the set of one or more world clocks being displayed according to the prioritization of the plurality of locations.

11. The method of claim 10, wherein the set of one or more world clocks is displayed as a scrollable list of work clocks.

12. The method of claim 10, further comprising:

displaying geolocation information for the one or more of the plurality of locations.

13. The method of claim 1, further comprising:

receiving user input to access contact information for one or more of the user contacts; and displaying, on the user interface, the contact information together with time information for the one or more of the user contacts.

14. The method of claim 13, wherein the time information is displayed as one or more of a local time for each of the one or more user contacts, or a color or an icon representing a time of day corresponding to the local time for each of the one or more user contacts.

15. The method of claim 1, further comprising:

receiving user input to initiate a communication with one or more of the user contacts; and displaying, on the user interface, a notification indicating the time information for the one or more of the user contacts.

16. The method of claim 15, wherein the notification includes a prompt requesting confirmation from the user to proceed with the communication.

17. The method of claim 1, wherein the user interface is part of a portable electronic device.

18. The method of claim 1, wherein the user interface is part of a wearable electronic device.

19. The method of claim 18, wherein one or more of the contact records or pieces of the context information are stored on a separate device that is communicatively coupled to the wearable electronic device.

20. A method for automatic generation of time information for display on a user interface, the method comprising:

accessing, by an electronic device, context information of a user of the electronic device, the context information indicating a plurality of locations, each location associated with a subset of user contacts of the user of the electronic device;

filtering, by the electronic device, the plurality of locations to a set of remote locations that are outside of a time zone of a current location of the user;

prioritizing, by the electronic device, the set of remote locations; and generating, by the electronic device, time information for display on the user interface based on the prioritization of the set of remote locations for display on the user interface, wherein displaying the time information includes:

in accordance with a determination that a first location associated with a first subset of the user contacts has a first prioritization determined based on communications associated with a plurality of contacts in the first subset of the user contacts and a second location associated with a second subset of the user contacts has a second prioritization determined based on communications associated with a plurality of contacts in the second subset of the user contacts:

displaying a current time at the first location in a first region of the display; and displaying a current time at the second location in a second region of the display; and in accordance with a determination that the first location has the first prioritization determined based on communications associated with the plurality of contacts in the first subset of the user contacts and a third location, different from the second location and associated with a third subset of the user contacts, has the second prioritization determined based on communications associated with a plurality of contacts in the third subset of the user contacts:

displaying the current time at the first location in the first region of the display; and displaying a current time at the third location in the second region of the display, wherein the current time at any one location is displayed in not more than one region of the display.

21. The method of claim 20 further comprising:

displaying, together with the current time associated with a given one of the plurality of locations, names of at least two user contacts in the subset of the user contacts associated with the given one of the plurality of locations.

22. The method of claim 20, wherein the set of remote locations are prioritized based on one or more of:

a number of pieces of the context information corresponding to each remote location;

a frequency of the user accessing the context information corresponding to each remote location; or an amount of time that has elapsed since the user last accessed the context information corresponding to each remote location.

23. The method of claim 20, wherein the context information includes one or more of:

a location history of the user;

a communication indicating one or more of the plurality of locations of the user; and application data indicating one or more of the plurality of locations of the user.

24. An electronic device comprising:

a processor; and a memory coupled to the processor and storing code executable by the processor to cause the electronic device to:

access contact records of user contacts of the electronic device;

determine a plurality of locations for the user contacts based on context information of the contact records, wherein a prioritization of the plurality of locations is determined based at least in part on the context information; and generate time information for display on a user interface based on the prioritization of the plurality of locations, wherein displaying the time information includes:

in accordance with a determination that a first location associated with a first subset of the user contacts has a first prioritization determined based on communications associated with a plurality of contacts in the first subset of the user contacts and a second location associated with a second subset of the user contacts has a second prioritization determined based on communications associated with a plurality of contacts in the second subset of the user contacts:

displaying a current time at the first location in a first region of the display; and displaying a current time at the second location in a second region of the display; and in accordance with a determination that the first location has the first prioritization and a third location, different from the second location and associated with a third subset of the user contacts, has the second prioritization determined based on communications associated with a plurality of contacts in the third subset of the user contacts:

displaying the current time at the first location in the first region of the display; and displaying a current time at the third location in the second region of the display, wherein the current time at any one location is displayed in not more than one region of the display.

25. The electronic device of claim 24, wherein the electronic device is a portable electronic device.

26. The electronic device of claim 25, wherein the portable electronic device is a wearable electronic device.

27. The electronic device of claim 25, wherein the portable electronic device is communicatively coupled to a wearable electronic device, and the user interface is part of the wearable electronic device.

28. The electronic device of claim 24 wherein the code executable by the processor further causes the electronic device to:

display, together with the current time associated with a given one of the plurality of locations, names of at least two user contacts in the subset of the user contacts associated with the given one of the plurality of locations.

* * * * *